United States Patent [19]

West

[11] 4,097,197

[45] Jun. 27, 1978

[54] LIQUID PRESSURE INTENSIFIER

[76] Inventor: Joe Edward West, 11426 Goodnight La., Dallas, Tex. 75229

[21] Appl. No.: 714,355

[22] Filed: Aug. 16, 1976

[51] Int. Cl.[2] ..... F04F 7/02; F04B 23/00

[52] U.S. Cl. ..... 417/227

[58] Field of Search ..... 417/225, 226, 227, 240, 417/241

[56] References Cited

U.S. PATENT DOCUMENTS

| | | | |
|---|---|---|---|
| 136,809 | 3/1873 | Bois | 417/226 |
| 539,146 | 5/1895 | Roussel et al. | 417/227 |
| 1,005,417 | 10/1911 | Courtet | 417/227 |
| 1,038,719 | 9/1912 | Bovee | 417/227 |
| 2,033,017 | 3/1936 | Watson | 417/226 |
| 3,188,963 | 6/1965 | Tyler | 417/225 |

FOREIGN PATENT DOCUMENTS

| | | | |
|---|---|---|---|
| 734,620 | 8/1932 | France | 417/227 |

*Primary Examiner*—John J. Vrablik

*Attorney, Agent, or Firm*—Thomas L. Cantrell; Joseph H. Schley

[57] ABSTRACT

Disclosed is a high pressure intensifier for liquids which includes a housing having a pair of interconnected intensifying chambers with a pair of orifice effect valves, one located in each chamber, but carried on a single stem. The valves are arranged to alternately block the flow of liquid from each chamber to a low pressure exhaust port. Each intensifying chamber is provided with a high pressure exhaust port having a check valve therein. Liquid is fed to each chamber through ram tubes arranged in a trombone configuration. When flow from one intensifying chamber to the low pressure exhaust is blocked, the inertia of the decelerating liquid in the ram tube for that chamber forces a stream of high pressure liquid out through the high pressure exhaust port for that chamber.

8 Claims, 4 Drawing Figures

LIQUID PRESSURE INTENSIFIER

BACKGROUND OF THE INVENTION

High pressure liquid, especially water, is required for various applications such as car washing, descaling of steel plate, fire fighting, debarking of logs, liquid jet mining, etc. Usually the requirement is for relatively small volume flow rates, and the high pressure is developed by pumps located near the point of use. Heretofore, pumps for high pressure applications have been heavy, complex, and expensive. In addition, they have proved susceptible to rapid wear because of the tight fits between sliding parts necessary to contain the high internal pressures.

SUMMARY OF THE INVENTION

In accordance with the present invention, a liquid pressure intensifier is provided which exploits the forces which can be developed upon the decleration of a moving column of liquid. In its preferred form, the intensifier of the invention includes a housing with a pair of intensifying chambers, one located at each end of the housing. The chambers are interconnected by a central bore in the housing, and an exhaust port communicates with the central bore.

Each of the intensifying chambers has a high pressure exhaust port with a check valve in it oriented to prevent backflow into the chamber. Each chamber also has an inlet port connected to a liquid ram tube.

There are two liquid ram tubes, one for each chamber, which extend linearly away from the intensifier housing, and lie parallel to, and in close proximity to, each other. An extension of the ram tubes, in the form of a single reaction ram tube, or a pair of reaction ram tubes, extends linearly back along the path of the ram tubes, parallel to, and in close proximity to them. The overall ram tube system thus has a "trombone" configuration. The term "trombone" configuration is used to indicate that the reaction tube or tubes lie close to and parallel to the primary ram tubes and the two kinds of tubes are interconnected to turn the flow around in direction. Various turnaround means may be employed — manifolds, pipe fittings, or simple tube bends. A unit with a single reaction ram tube resembles an "M" in layout; a double tube unit resembles a pair of inverted "U's" in layout. The reaction tube or pair of tubes terminates in a liquid input fitting.

A valve mounting stem extends through the central bore of the housing and carries an orifice-effect valve on each end thereof, one valve being positioned in each of the intensifying chambers. Each of the valves is adapted to seat against the bottom of its chamber, to thereby block flow of liquid from the chamber, through the central bore and out the exhaust port. Since the two valves are mounted on a common stem, one will be open while the other is closed, and when one is in the process of closing, the other is in the reciprocal process of opening.

In operation, with one valve open and the other closed, liquid flows into the intensifying chamber having the open valve. As the liquid velocity builds, a velocity is reached at which the pressure drop across the orifice-effect valve in that intensifying chamber is sufficient to force the valve to close.

When the valve closes, the liquid moving through the ram tube toward the intensifying chamber with the closed valve tends to continue in motion and must be stopped, or at least materially decelerated by the walls of the intensifier housing. The weak point in these walls is the spring loaded check-valve in the exhaust port of the chamber. The check-valve opens, and a stream of high pressure liquid escapes through the exhaust port.

Meanwhile, upon opening of the valve in the other intensifying chamber, liquid starts to flow through that chamber and out the exhaust port. In due course, the velocity of liquid flow through that chamber builds to the point where its orifice effect valve closes, and a spurt of high pressure liquid escapes from that chamber through its exhaust port.

The inertia forces in the decelerating column of liquid in either of the ram tubes tend to move the entire apparatus in the direction of the exhaust ports. In accordance with the invention, this tendency is balanced out or eliminated by providing a reaction tube (or pair of tubes) of substantially the same dimensions as the ram tubes, though which incoming liquid passes in a direction opposite to the flow through the ram tubes, on its way to the ram tubes. When liquid in a ram tube is being decelerated, and exerting forces in the direction of the exhaust ports, an equal quantity of liquid is being equally decelerated in the opposite direction in the reaction tube, and it is exerting equal forces on the apparatus in a direction away from the exhaust ports. With the forces balanced, the apparatus tends to stay put. In addition, the pressure of the liquid in the reaction tube contributes to the development of high output pressure.

From the foregoing it can be seen that the principal objects of the present invention are to provide a high pressure intensifier for liquids which is simple in construction and operation, economical to build, reliable in operation, and capable of scaling to a wide range of sizes.

The manner in which the foregoing objects and purposes, together with other objects and purposes, are accomplished may best be understood by a consideration of the detailed description which follows, together with the accompanying drawings.

DESCRIPTION OF THE PREFERRED EMBODIMENTS

Figure 1:
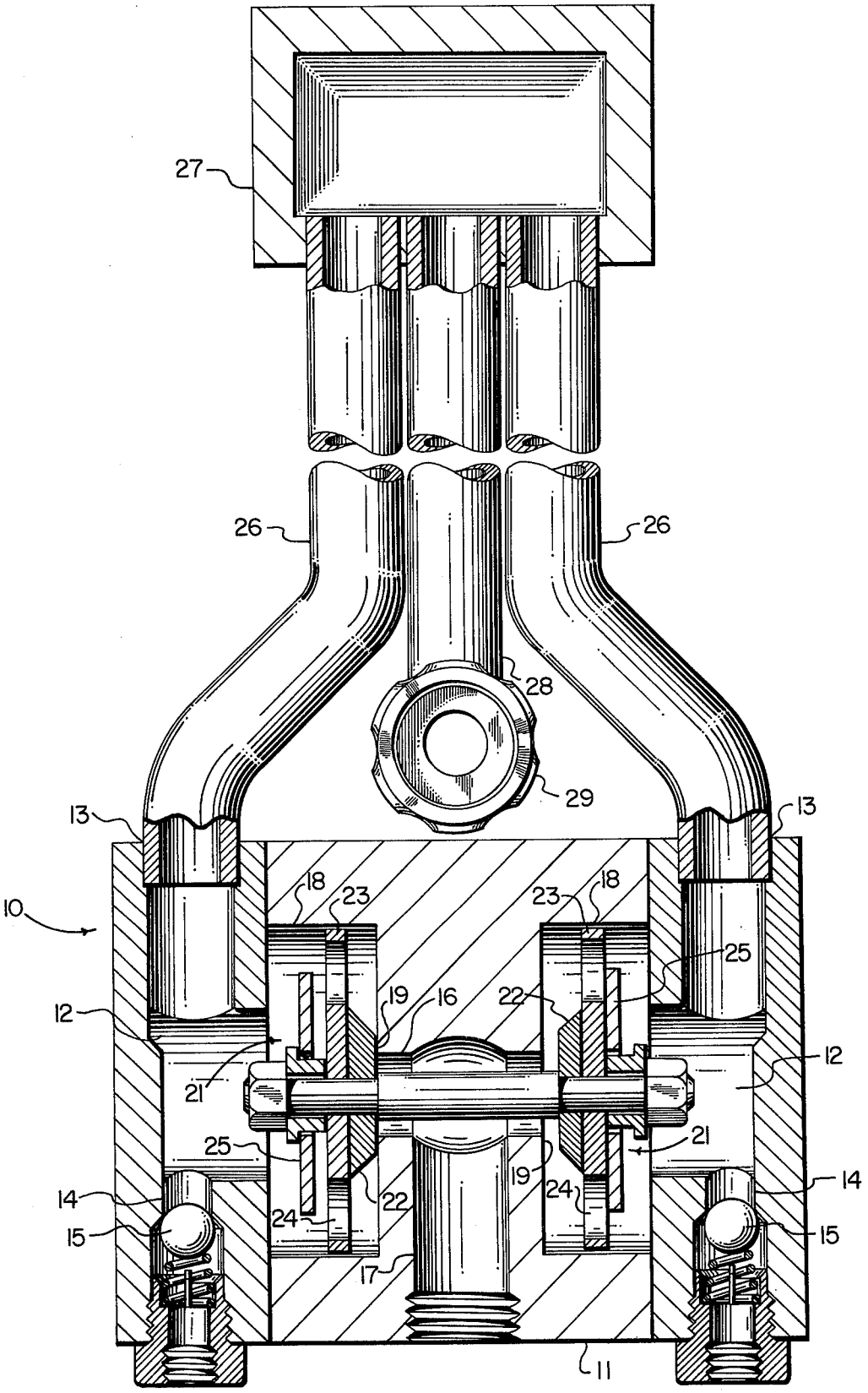
FIG. 1 is an plan view, partly in section, of a liquid pressure intensifier of the invention.

Attention is first directed to FIG. 1, where an intensifier constructed in accordance with the invention is designated generally as 10. It includes an intensifier housing 11, which for convenience in construction is formed in three pieces. Within housing 11, at each end thereof, are a pair of intensifying chambers 12. Each intensifying chamber 12 has a liquid inlet 13, and a high pressure outlet 14. The high pressure outlets 14 are each provided with ball-type check valves 15 which are spring biased to the closed position, and which permit flow out of, but not into, the chambers.

Within intensifier housing 11, the intensifying chambers 12 are interconnected by a central bore 16, and a transverse bore intercepts central bore 16 to form a low pressure exhaust outlet 17.

It should be noted that each of the intensifying chambers 12 is configured so that its inner end forms a cylindrical valve bore 18. Bores 18 are axially aligned with each other and with central bore 16. They are of greater diameter than central bore 16, so that their bottoms form valve seats 19.

Running through central bore 16 and bores 18 is valve stem 20, at each end of which are mounted orifice-effect valve assemblies designated generally as 21.

Each valve assembly 21 includes a valve proper 22, positioned to seat against valve seat 19. Overlying valve 22 is an apertured plate 23, which is sized to slidingly fit in bore 18 and thus align the valve assemblies and stem 20. Apertured plates 23 and provided with a plurality of circumferentially spaced apertures 24. Overlying apertured plates 23 are supplemental plates 25. As can be seen from FIG. 1, plates 25 partially overlie the apertures 24 in plates 23. Apertured plate 23 and its supplemental plate 25 together comprise an orifice plate, and the partially blocked apertures 24 collectively comprise an orifice. By changing the size of supplemental plate 25, one can change the size of this orifice and hence change the pressure or liquid velocity at which the orifice-effect valve will operate.

When one of the orifice-effect valves 21 is open, liquid flows through it from the intensifying chamber 12 to the central bore 16 and low pressure exhaust port 17 by passing through the partially obscured apertures 24 and through the gap between the valve proper 22 and valve seat 19. As the liquid velocity builds up, so does the pressure drop across plates 23–25, and eventually it reaches a level great enough to force valve 22 against its seat 19, thereby blocking flow into bore 16 and out low pressure exhaust port 17. Closure of the valve 22 is very rapid. Supplemental plate 25 is floatingly mounted on stem 20 so that it can lag behind the closing movement of the remainder of the valve assembly, thereby avoiding the imposition of unnecessary and objectionable drag on the closing action.

A pair of ram tubes 26 extend from inlet ports 13 to flow-reversing manifold 27. Ram tubes 26 are equal in length and inside diameter. They extend linearly away from pump housing 11, and are arranged to lie parallel to and closely adjacent each other.

Reaction tube 28 extends from inlet fitting 29 to manifold 27. It has the same inside diameter as ram tubes 26, and is substantially co-equal with them in length. It is arranged to lie in close proximity to, and parallel to, the ram tubes 26.

The ram tubes 26 are of a length and diameter sufficent to enable the establishment, alternately in one ram tube and then the other, of a column of moving liquid with the desired mass and velocity proceeding toward the intensifying chamber 12 just at the instant valve 22 closes. Their exact size will depend on the input pressure and the desired output pressure. They may extend horizontally, as in FIG. 1, or vertically, as in FIG. 4, or at any other angle.

Reaction tube 28 is of a size sufficient to enable the establishment therein of a moving column of liquid having, at any time, substantially the same mass and velocity and the moving columns of liquid in one of the ram tubes. The direction of movement of the reaction tube liquid is substantially opposed to the direction of movement of the ram tube liquid.

Figure 2:
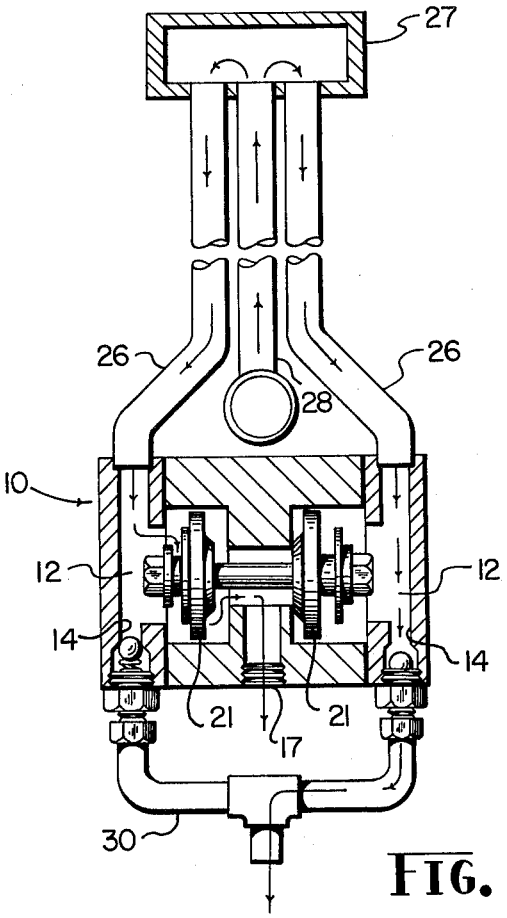
FIGS. 2 and 3 are somewhat diagrammatic plan views partly in section, of the intensifier of FIG. 1, showing steps in the cycle of operation.
Figure 3:
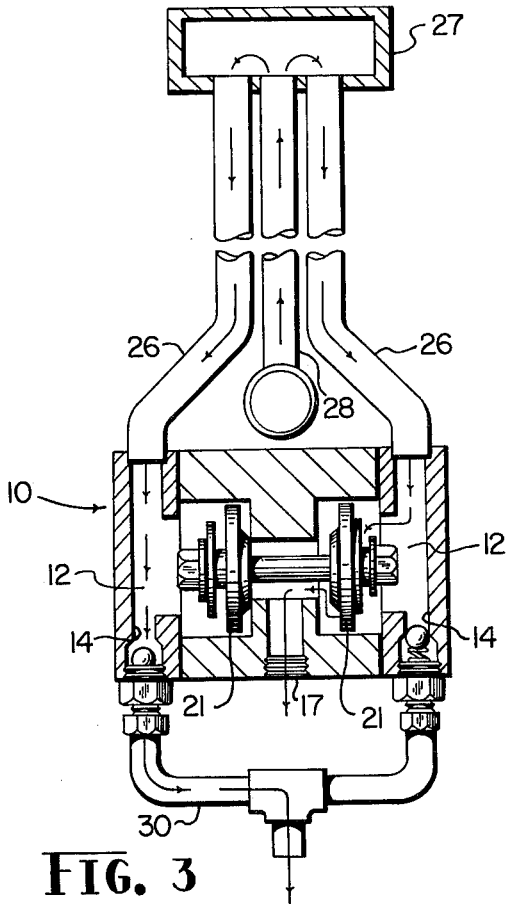

Attention is now directed to FIGS. 2 and 3 from which the operation of the intensifier of the invention may be understood. The unit shown in FIGS. 2 and 3 is substantially the same as the unit shown in FIG. 1, except that high pressure exhaust ports 14 have been yoked together by piping 30 to provide a single high pressure outlet to which hose or piping leading to the point of use may be connected.

FIG. 2 shows the liquid flow paths in the intensifier at the instant just after closure of the right hand valve 21 by means of small flow arrows. Since the flow from right hand chamber 12 to low pressure exhaust port 17 is blocked, the moving column of liquid in right hand ram tube 26 is being decelerated toward a standstill, and stream of high pressure liquid is issuing through open high pressure exhaust port 14 into piping 30.

At the same time the moving column of liquid in reaction ram tube 28 is being decelerated toward a standstill.

Simultaneously, the column of decelerated liquid in left hand ram tube 26 is beginning to accelerate, and liquid is starting to flow through left hand valve 21, which is open, and out low pressure exhaust port 17. High pressure port 14 on the left side is closed.

As the velocity of liquid moving through open left hand valve increases, it reaches a point sufficient to close that valve and open the right hand valve. When this occurs, the flow conditions shown in FIG. 3 obtain. High pressure liquid moves through left hand port 14; liquid in left hand ram tube 26 is decelerating, as is the reaction tube liquid; and liquid in right hand ram tube 26 is beginning to accelerate and move through right hand valve 21 to low pressure port 17.

In operation the intensifier cycles between the two conditions shown in FIGS. 2 and 3.

Figure 4:
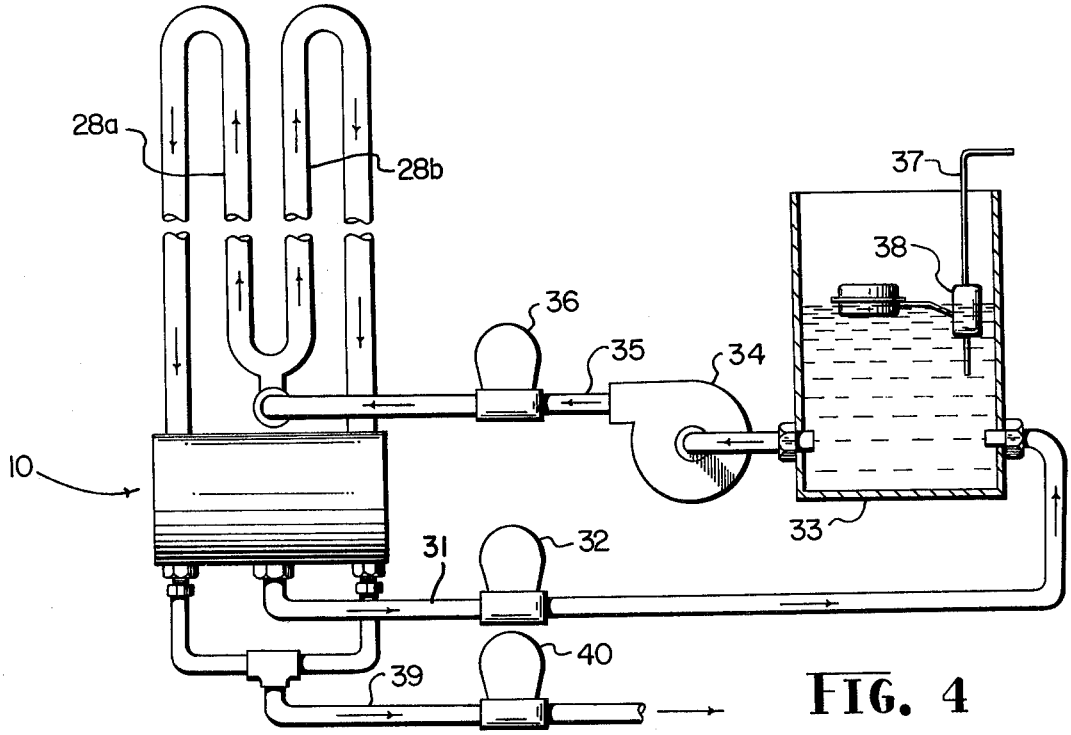
FIG. 4 is a diagrammatic elevational view of an intensifier of the invention equipped to recycle exhaust water.

Attention is now directed to FIG. 4. In the discussion thus far, it has been assumed that liquid issuing from low pressure exhaust port 17 is put to a secondary use or discarded. However, in the embodiment of FIG. 4 provision is made to recycle such exhaust liquid back into the unit.

It should first be noted that the unit of FIG. 4 is one employing a pair of reaction tubes **28*a*, and 28*b***, and that no manifold is used; instead, liquid turnaround is achieved through tube bends.

Low pressure exhaust line 31 leads through accumulator 32 to tank 33. Recycle pump 34 pumps liquid from tank 33 into supply line 35, which is also equipped with an accumulator 36. Supply main 37 delivers make-up liquid to tank 33 at a rate controlled by float valve 38.

High pressure line 39 is provided with an accumulator 40 to smooth the pulses of high pressure liquid passing through it originating alternately from the left side and the right side of intensifier 10.

I claim:

1. A high pressure intensifier for liquids comprising:

a housing having an intensifying chamber therein, said chamber being provided with an inlet, a low pressure outlet, and a high pressure outlet;

a valve in said chamber positioned to block flow through said low pressure outlet upon closure thereof;

means for closing said valve when the velocity of liquid flow therepast reaches a selected value;

means for opening said valve;

a ram tube connected to said inlet and extending linearly away therefrom;

and a reaction ram tube connected to the ram tube at its end remote from said housing, said reaction ram tube extending parallel to and lying closely adjacent said ram tube, and extending back toward said housing and terminating adjacent thereto in a liquid inlet;

said reaction ram tube being substantially equal to said ram tube in length and diameter.

2. A high pressure intensifier for liquids comprising a housing;

a pair of intensifying chambers in said housing, each having a liquid inlet, a low pressure outlet, and a high pressure outlet;

a pair of orifice effect valves, one positioned in each chamber for blocking flow through the respective low pressure outlets of said chambers upon closure thereof;

means for opening one of said valves when the other of said valves closes;

a pair of ram tubes each connected to a chamber inlet, said tubes extending linearly away from said housing, and lying parallel to and closely adjacent each other;

at least one reaction ram tube connected to the outer ends of said ram tubes, lying parallel to and closely adjacent thereto, and extending toward said housing and terminating adjacent thereto in a liquid inlet;

said reaction ram tube being substantially equal to said ram tubes in length and diameter.

3. A high pressure intensifier for liquids comprising a housing;

a pair of intensifier chambers in said housing interconnected with each other by a passage;

a low pressure exhaust port in said passage;

a valve stem extending through said passage from one chamber to the other, said stem having a length greater than the distance between said chambers;

a pair of orifice effect valves, one positioned in each of said chambers, both of which are mounted on said valve stem for reciprocating movement therewith to alternately block liquid flow from a chamber to said passage;

a high pressure exhaust port in each pumping chamber;

a liquid inlet in each pumping chamber;

a pair of ram tubes of substantially equal length and diameter, one connected to each of said inlets, said ram tubes extending generally linearly away from said housing, said ram tubes being substantially parallel and lying closely adjacent each other;

and at least one reaction ram tube interconnected to said ram tubes at their ends remote from said housing, said reaction ram tube extending toward said housing and being substantially parallel to and lying closely adjacent said ram tubes, said reaction ram tube being further provided with a liquid inlet at its end adjacent said housing;

said reaction ram tube being substantially equal to said ram tubes in length and diameter.

4. An intensifier in accordance with claim 3 in which said orifice effect valves each comprise a valve element mounted on said stem and seatable against a wall of the chamber in which it is positioned at the intersection of said passage and said chamber, and an orifice plate mounted on said stem endwise thereof from said valve element.

5. An intensifier in accordance with claim 3 and further comprising a pair of reaction ram tubes, one connected to each of said ram tubes.

6. An intensifier in accordance with claim 3 and further comprising means for recycling liquid issuing from said low pressure exhaust port.

7. An intensifier in accordance with claim 6 in which said recycle means comprise a liquid supply tank, an exhaust line running from said low pressure exhaust port to said tank, an accumulator in said exhaust line, a supply line running from said tank to the inlet of said reaction ram tube, a pump in said supply line, an accumulator in said supply line between said pump and said reaction ram tube inlet, and means for introducing make-up liquid to said tank.

8. a high pressure intensifier for liquids comprising a housing;

a pair of intensifier chambers in said housing interconnected with each other by a passage;

a low pressure exhaust port in said passage;

a valve stem extending through said passage from one chamber to the other, said stem having a length greater than the distance between said chambers;

a pair of orifice effect valves, one positioned in each of said chambers, both of which are mounted on said valve stem for reciprocating movement therewith to alternately block liquid flow from a chamber to said passage;

a high pressure exhaust port in each pumping chamber;

a liquid inlet in each pumping chamber;

a pair of ram tubes, one connected to each of said inlets, said ram tubes extending generally linearly away from said housing, said ram tubes being substantially parallel and lying closely adjacent each other;

and at least one reaction ram tube interconnected to said ram tubes at their ends remote from said housing, said reaction ram tube extending toward said housing and being substantially parallel to and lying closely adjacent said ram tubes, said reaction ram tube being further provided with a liquid inlet at its end adjacent said housing;

said orifice effect valves each comprising a valve element mounted on said stem and seatable against a wall of the chamber in which it is positioned at the intersection of said passage and said chamber, and an orifice plate mounted on said stem endwise thereof from said valve element;

said orifice plate comprising an apertured plate mounted on said stem for movement therewith, and an overlying supplemental plate at least partially obscuring the apertures in said apertured plate, said supplemental plate being floatingly mounted on said stem for movement toward and away from said apertured plate.

* * * * *